United States Patent [19]

Kloos

[11] 4,168,857

[45] Sep. 25, 1979

[54] CRANE WITH LUFFING SYSTEM SUITABLE FOR HANDLING BOTH GENERAL CARGO AND CARGO CONTAINERS

[75] Inventor: Petrus J. Kloos, IJsselstein, Netherlands

[73] Assignee: B.V. Machinefabriek Figee, Haarlem, Netherlands

[21] Appl. No.: 863,689

[22] Filed: Dec. 22, 1977

[30] Foreign Application Priority Data

Dec. 29, 1976 [NL] Netherlands ..... 7614540

[51] Int. Cl.[2] ..... B66C 1/62

[52] U.S. Cl. ..... 294/81 SF; 294/67 DA

[58] Field of Search ..... 212/125, 14, 11, 40, 212/41, 83, 77; 294/81 SF, 67 DA, 67 R

[56] References Cited

U.S. PATENT DOCUMENTS

| | | | |
|---|---|---|---|
| 1,865,739 | 7/1932 | Bergmann | 294/67 DA |
| 1,976,014 | 10/1934 | Forsythe | 294/67 DA |
| 3,210,114 | 10/1965 | Lawton | 294/81 SF |
| 3,842,986 | 10/1974 | Hupkes | 294/67 R X |
| 3,899,083 | 8/1975 | Flessner et al. | 212/125 |

*Primary Examiner*—Albert J. Makay

*Attorney, Agent, or Firm*—Biebel, French & Nauman

[57] ABSTRACT

A crane with luffing system, in which at least two front pulleys are present, slightly interspaced from each other. Over the front pulleys run hoisting ropes to a hoisting trestle carrying the load hook. The hoisting trestle is connected to a slewing table via a torsion-resistant rope frame. The slewing table is composed of two separate plates rotatable relative to each other, of which the lower one is connected via a torsion-resistant rope frame to a container spreader to which a container may be secured. Through rotation of the lower slewing plate relative to the upper one it is easy to accurately maneuver a container suspended by the crane.

12 Claims, 11 Drawing Figures

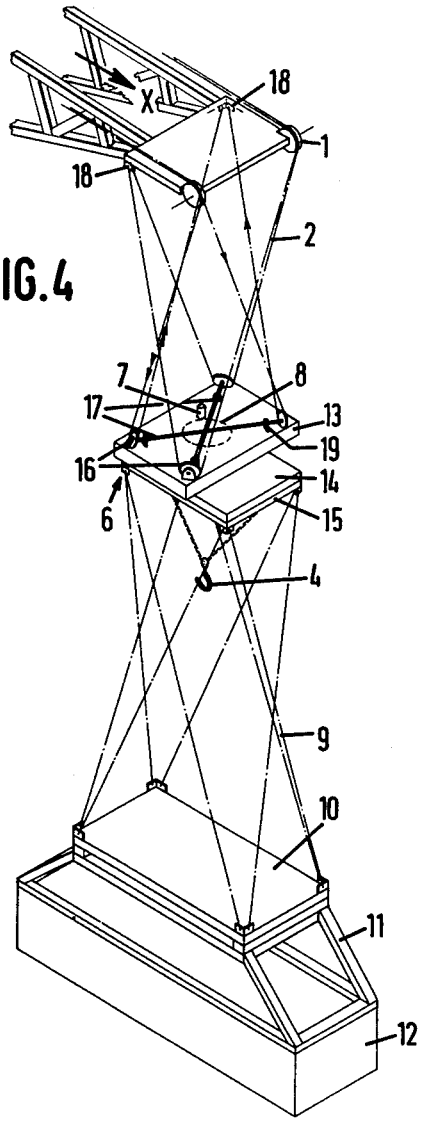
FIG.4
FIG.5a
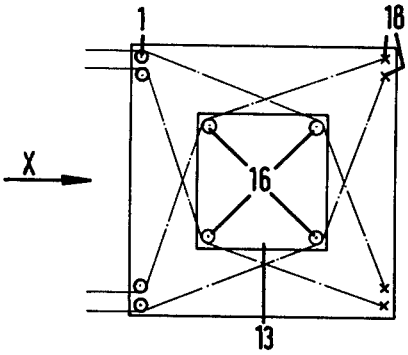
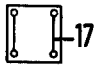
FIG.5b
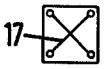
FIG.5c
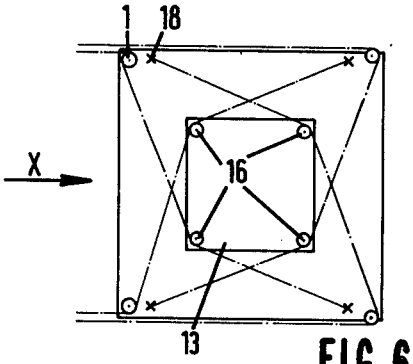
FIG.6a
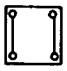
FIG.6b
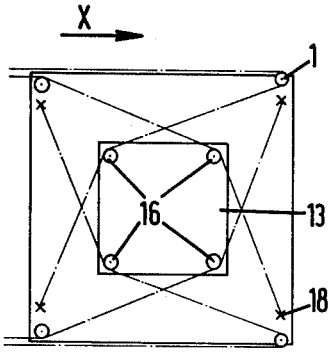
FIG.7a
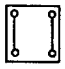
FIG.7b

CRANE WITH LUFFING SYSTEM SUITABLE FOR HANDLING BOTH GENERAL CARGO AND CARGO CONTAINERS

For loading and unloading cargo containers most ports have separate quays provided with special loading and unloading cranes, usually of the portal type, exclusively suitable for loading and unloading cargo containers.

However, in most ports there are a great many cranes with luffing system, such as level-luffing cranes and tumbler cranes available for loading and unloading general cargo or bulk cargo. Such cranes are provided with at least one hoisting rope guided over a front sheave, a load hook and a container spreader which may be connected to the hoisting rope and which engages the corner points of a container to be displaced.

Such cranes are less suitable for loading an unloading cargo containers. The major objection is that no means are available for slewing the cargo container in a substantially horizontal plane. This has to be effected manually, possibly through application of aids such as winches and the like. Since cargo containers, in filled condition, may have a weight of about 30 tons, said slewing is a very laborious operation. Another drawback is the inclined position of the container bottom as a result of an eccentric centre of gravity, in which position the centre of gravity comes to lie underneath the front pulley. This inclined position is undesirable during the deposition of containers in the hold of a vessel or on a truck. True, use may be made of self-levelling systems acting on the container spreader for compensating said inclined position, but these systems render the apparatus much more complicated and as a result very sensitive to disturbances.

It is the object of the present invention to render a crane of the above described type suitable for both cargo containers and general cargo operations, whereby the above described objections are eliminated. The crane according to the invention is characterized to this effect in that the top of the crane accommodates at least two front pulleys spaced apart from each other, while between the front pulleys and the container spreader there are disposed a hoisting trestle having a load hook for handling general cargo and slewing means, while at least two hoisting ropes guided over the front pulleys engage the hoisting trestle and the slewing means such that the assembly of hoisting ropes—trestle—slewing means has a maximum torsion resistance, while a master trestle is disposed on the container spreader which is connected to the slewing means through a securing system that is stiff in torsion.

By interspacing the front pulleys and causing the superposed hoisting ropes to engage at about the same interspace the hoisting trestle-slewing means assembly, there is introduced a certain resistance moment against torsion of said system. This construction makes it possible in a simple manner to slew the container through 90° in a substantially horizontal plane so that it can be rotated from a position perpendicular to the crane jib into a position wherein the container lies about parallel to the jib.

In order to increase the stability of the construction and to eliminate the inconveniences of an eccentric centre of gravity in two mutually perpendicular directions, preferably four instead of two front pulleys are employed, which are disposed pairwise slightly spaced from the vertical medium plane through the crane jib, four hoisting ropes running over said pulleys towards the angular points of the hoisting trestle-slewing means assembly which is provided at least on one side with an equalizer sheave construction. In this manner the torsion stiffness of the construction between the front pulleys and the slewing means is considerably increased and as a result also the stability of the container during the slewing thereof.

The slewing means—hoisting trestle assembly as well as the securing system between master trestle and slewing means has a torsion-stiff design. This stiffness in torsion may be obtained by applying a first rope frame between the slewing table and the hoisting trestle, and alternatively, a second rope frame between the table and the master trestle as well, each rope frame comprising at least 8 diagonally extending ropes and each angular point of the slewing table being connected to two angular points of the trestle, or in the case of the second rope frame to the master trestle, which two angular points are positioned on either side of the plane to said angular point and the vertical axis of the rope frame.

Said torsion-resistant suspension is necessary since otherwise there will occur difficultly controllable torsional vibrations during the slewing of the cargo container by means of the slewing table between the front pulleys and the container. Said slewing table according to the invention preferably comprises two substantially parallel, preferably rectangular structural elements which are interconnected through a ball race, a motor being secured on the upper plate which is adapted to rotate the lower plate relative to the upper via a geared transmission.

In a different embodiment the hoisting ropes themselves are connected to the slewing table in the manner of a torsion-resistant rope frame. The load hook is directly suspended from the slewing table and there is disposed a coupling frame which is secured to the bottom of the slewing table element, while on the top side in the angular points of the slewing table element, there are disposed four rope or traction sheaves which are connected pairwise through connecting shafts, each hoisting rope being conducted over a front pulley, a rope or traction sheave disposed on the slewing table back to a rope attachment point in the top of the crane jib.

Since during the transhipment of cargo containers in the hold of a vessel it is necessary to stack a number of containers onto each other and it is necessary to avoid jamming of the slewing table in the hatchway, the distance between the slewing table and the master trestle is preferably at least four times the maximum container height.

In order to easily switch over from container handling to general cargo handling, the first rope frame which connects the hoisting trestle to the slewing table is detachably secured to the hoisting trestle. Also, the second rope frame may be detachably connected to the slewing table. In the latter case the slewing table, in case of general cargo handling, remains suspended from the hoisting ropes and in the former case the slewing table is temporarily disconnected.

Some embodiments of the apparatus according to the present invention will now be explained, by way of example, with reference to the accompanying drawings, in which:

FIG. 4 shows a second embodiment in which the hoisting ropes themselves constitute a rope frame construction;

FIGS. 5*a*–7*b* diagrammatically show alternatives for the location of the front pulleys and rope attachment points in the crane jib with associated connecting shafts for the rope or traction sheaves on the slewing table.

Figure 1:
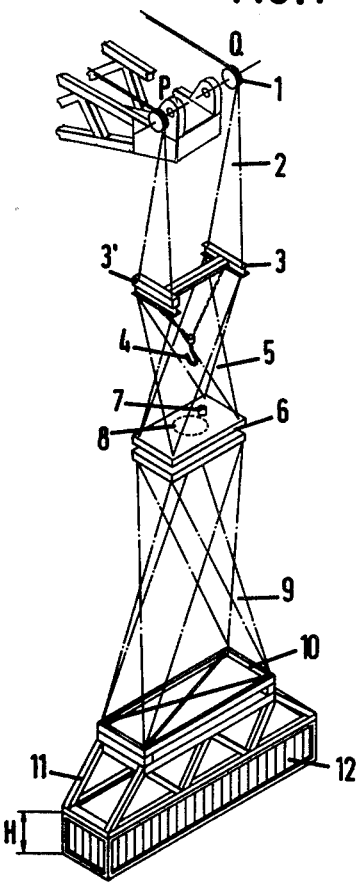
FIG. 1 shows an apparatus according to the invention, in which a cargo container is suspended in a position perpendicular to the crane jib whose luffing line is shown.

In FIG. 1 are indicated by 1 the front pulleys of a crane with luffing system, e.g. a port derricking or level-luffing crane, four in total, which are disposed pairwise on a shaft extending through the top of the crane jib. A pair of pulleys P is disposed at the one side of a vertical plane going through the axis of the jib, while the other pair Q is disposed at the other end of said plane. The distance between the pulley pairs P and Q is preferably about 5 meters. Underneath said front pulleys there is disposed the hoisting trestle 3 which in the embodiment shown has the form of a double T-shaped trestle, however which may also be rectangular or otherwise designed, at the four angular points thereof there are disposed hoisting ropes, each running over one of the front pulleys. In order to ensure a stable three-point suspension of the hoisting trestle 3, there is disposed at least on one side of the trestle 3 a so-called equalizer sheave 3', as known per se. Such an equalizer sheave construction makes it possible that the hoisting ropes 2 running over the pair of pulleys P are equally loaded. The distance from the trestle 3 to the front pulleys 1 is in practice minimally about 8 and maximally about 50 meters. Suspended from trestle 3 is a load hook 4 by means of two ropes or chains and in this form the crane is suitable for handling general cargo. For transhipment of cargo containers 12 a first hoist frame 5 may be secured to the hoisting trestle 3, which frame comprises eight diagonally extending ropes, each angular point of the trestle 3 being connected to two angular points of a slewing table 6 in such a way that these diagonally extending ropes are always coplanar, going through two successive angular points of the hoisting trestle 3 and the parallel edge of the slewing table 6. Naturally the angular points of the trestle 3 may also be connected through substantially vertically extending ropes to the subjacent angular point of the slewing table 6. Consequently, the first rope frame 5 comprises minimally eight diagonally extending ropes, while said rope frame may be extended yet by four substantially vertical ropes. The distance between the hoisting trestle 3 and the slewing table 6 is preferably about 3 meters. In this manner the relative position of the trestle 3 and the table 6 is fixed. At the bottom of the slewing table there is secured a rope frame 9 corresponding to the first frame 5, comprising at least eight diagonally extending ropes. Also in this second rope frame, correspondingly to rope frame 5, each angular point of the slewing table 6 is connected to two angular points of the master trestle 10, in such a way that crossing ropes always lie in one plane going through an edge of the slewing table 6 and the parallel edge of the master trestle 10. Also in this second rope frame 9 it is possible to connect the angular points of the slewing table 6 to the corresponding angular points of the master trestle 10. The distance between the slewing table 6 and the master trestle 10 is preferably about 10 meters, however in vessels wherein more than five cargo containers are stacked onto each other in the hold, said distance may be increased without any inconvenience, however, the torsion resistance of the second rope frame 9 will be slightly reduced thereby.

In the embodiment shown the master trestle 10 comprises a rectangular construction having adequate rigidity which has substantially the same form as the rectangular container spreader 11, which is known per se, and consists of a rectangular construction, at the angular points of which there are disposed pivoting arms, so-called twist-locks, which may be secured to the angular points of the cargo container. By means of such a known per se container spreader 11 cargo containers 12 of different sizes may be loaded and unloaded. In principle the master trestle 10 may be secured similarly to the container spreader as said spreader 11 itself to the container 12. Such attachments may have many designs and are known per se.

The container 12 for instance may have sizes of 12.5×2.5×2.5 meters and in filled condition have a weight of about 30 tons. In view of these sizes and weights, such containers 12, suspended from a crane in the hold of a vessel, can only be handled with difficulty. The slewing table 6 functions to maneuver the containers 12 as explained below with reference to FIG. 3.

Figure 3:
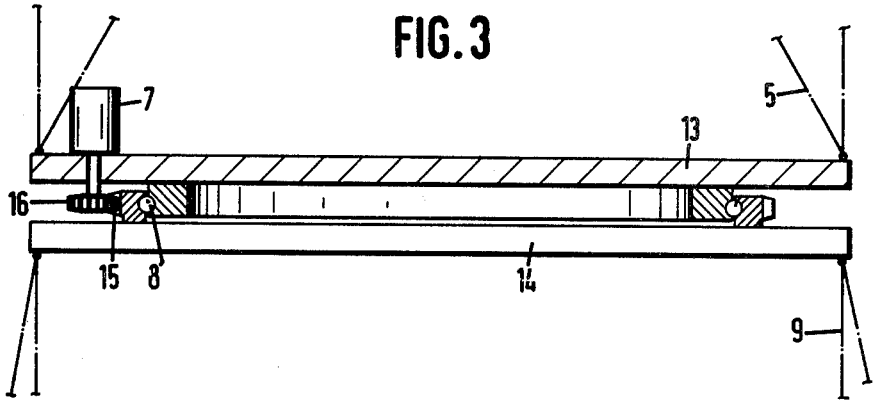
FIG. 3 shows the slewing table in cross-section.

FIG. 3 shows the slewing table 6 in cross-section, which table 6 substantially comprises two parallel, preferably rectangular flat elements 13, 14, while the lower plate 14 is adapted for rotation through a ball race 8 relative to the upper plate 13 via the slewing motor 7 which is fixedly disposed on the upper plate 13. At the exterior of the ball race 8 there are present teeth 15, which are in engagement with a gear 16 which is affixed to the shaft of motor 7.

When motor 7 is driven, the lower plate 14 will in principle be rotated relative to the upper plate 13. However, this movement is not directly transmitted from plate 13 to plate 14, since the four hoisting ropes 2 between the head of the jib and the hoisting trestle 3 form an insufficiently torsion-resistant construction to constitute a sufficiently large resistance moment. When starting the motor 7 the rope frame will therefore rotate through an angle relative to the axis through the pulleys 1 and consequently will entrain the trestle 3. It appears in practice that the maximal angular displacement of the trestle 3 is about 15°–30°. With such an angular displacement the resistance moment of the hoisting ropes appears sufficiently large to impart an angular acceleration to the cargo container. The motor torque is subsequently kept constant for some time, after which deceleration of the motor shaft takes place. Immediately before reaching the required angular displacement of the cargo container, the motor shaft is driven in opposite direction, so that there is imparted to the hoisting trestle 3 an angular displacement opposite to the angular displacement of the cargo container. In this manner container 12 may be decelerated, thus avoiding pendulum motion or overshoot of the container.

Figure 2:
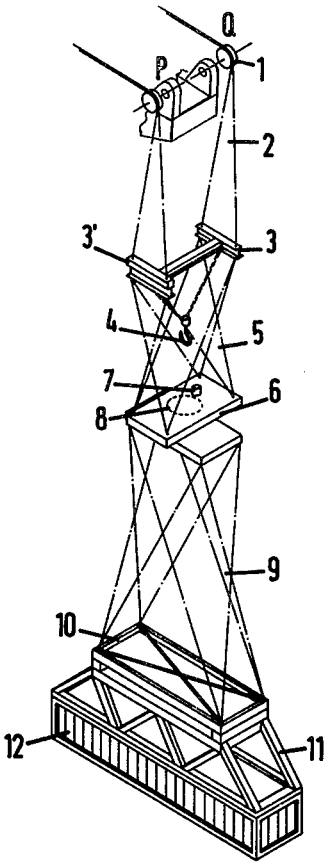
FIG. 2 shows the apparatus according to FIG. 1, in which the container is rotated through 90° relative to the position shown in FIG. 1.

FIG. 4 shows a second embodiment of the apparatus according to the present invention. The difference with the embodiment shown in FIGS. 1 and 2 consists in that in the embodiment shown in FIG. 4 the hoisting trestle 3 is combined with slewing table 6 as a single part. The hoisting trestle 3 is replaced in this case by a coupling frame 15 which for instance is secured to the bottom of the slewing table element 14 by means of twist-locks. The load hook 4 is likewise secured to the bottom of slewing table 6. Slewing table 6 is connected to the jib of the crane by means of four hoisting ropes which together constitute a rope frame. To this effect the jib of the crane accommodates attachment points 18 which together with the front pulleys 1 form a rectangle. On the slewing table element 13, in the angular points thereof, there are disposed the rope or traction sheaves 16 which are connected pairwise by means of the diagonally extending connecting shafts 17. Each hoisting rope runs over a front pulley 1 through a rope or traction sheave 16 and then to an attachment point 18 in the jib of the crane. The front pulley 1 associated with each hoisting rope 2 and the attachment point 18 lie in diagonal relationship opposite each other, while the associated rope or traction sheave 16 lies in the vertical plane going through the other diagonal of the rectangle which is formed by the front pulleys 1 and the rope attachment points 18. In this manner the four hoisting ropes 2 constitute a rope frame correspondingly to the rope frame 5 shown in FIG. 1. The rope or traction sheaves 16 are so connected pairwise that during the hoisting or lowering of the load two corresponding sheaves 16 have the same direction of rotation. When the slewing table element 13, however, is subjected in some manner to an angular displacement relative to the crane jib, the sheaves 16 interconnected by means of the connecting shafts 17 will be loaded in opposite rotation direction and consequently will counteract an angular displacement of the slewing table element 13. In this manner the torsion resistance of the rope frame formed by the hoisting ropes 2 will be increased. Naturally the sheaves 16 should lie in the plane formed by the hoisting rope 2 guided over said sheave, which implies that associated sheaves 16 cannot be perpendicular to the connecting shaft 17. This also implies that means such as universal joints 19 should be accommodated in shafts 17 in order to allow the system formed by two sheaves 16 and shaft 17 connecting said sheaves to rotate jointly.

In the embodiment shown in FIG. 4 the rope frame 9 can be disconnected from the slewing table element 14 in order to make the crane suitable again for handling general cargo. The slewing table 6 in that case continues to be suspended in the hoisting ropes, in contrast to the construction shown in FIGS. 1 and 2, wherein the slewing table 6 is disconnected from the hoisting trestle during the conversion of the crane from cargo container to general cargo handling.

FIGS. 5a–7b show a number of alternatives for applying the front pulleys 1 in the rectangle disposed in the top of the jib and the associated location of the rope attachment points 18 as well as the mutual coupling of the rope or traction sheaves 16. It will be clear that the interconnection of the sheaves 16 is dictated by the condition that during the hoisting and lowering of the load the associated sheaves 16 should have the same direction of rotation. In the variant shown in FIG. 5a the connecting shafts 17 may be applied both in the manner as shown in FIG. 5b and in a manner as shown in FIG. 5c. In the variants according to FIGS. 6a and 7a the connecting shafts 17 are to be applied as indicated in FIGS. 6b and 7b. Diagonally extending connecting shafts 17 are not possible in such location of the front pulleys 1 or attachment points 18.

An advantage of the construction shown in FIG. 4 consists in that the slewing table 6 remains horizontal during the luffing of the crane.

I claim:

1. A crane having a buffing system, said crane having a load hook for displacing general cargo and a cargo container spreader for engaging angular points of a container to be displaced, said luffing system comprising:

at least two front pulleys disposed in spaced relation from one another and supported by said crane;

slewing means and a hoisting trestle both disposed below said pulleys;

rope frame means supporting said slewing means and said hoisting trestle from said front pulleys and including at least two hoisting ropes disposed relative to said slewing means for providing torsional resistance upon rotation of said slewing means;

a master trestle supported on said container spreader; and further rope frame means securing said master spreader to said slewing means for providing torsional resistance therebetween upon rotation of said slewing means.

2. A crane according to claim 1 wherein there are four front pulleys (1) which are disposed pairwise (P,Q) slightly interspaced from the vertical medium plane through the crane jib, over which pulleys (1) run four hoisting ropes (2) towards angular points of said slewing means (6) and said hoisting trestle (3) is provided at least on one side with an equalizer sheave construction (3').

3. A crane according to claims 1 wherein the slewing means comprise a slewing table (6) connected to the hoisting trestle (3) by means of a first torsion-resistant rope frame (5) comprising at least eight diagonally extending ropes, each angular point of the slewing table (6) being connected to two angular points of the hoisting trestle (3), which two angular points are positioned on either side of the plane through said angular point and the vertical axis of the rope frame (5).

4. A crane according to claim 3, wherein between the slewing table (6) and master trestle (10) thereis accommodated a second torsion-resistant rope frame (9), each angular point of the slewing table (6) being connected to two angular points of the master trestle (10), which two angular points are positioned on either side of the plane through said angular point and the vertical axis of the rope frame.

5. A crane according to claim 3 wherein the slewing table (6) comprises two substantially parallel upper and lower rectangular structural elements (13, 14) which are interconnected through a ball race (8) to be mounted on the upper element (13), a motor (7) which, via a geared transmission (15, 16) is adapted to rotate the lower element (14) relative to the upper element (13).

6. A crane according to claim 2 wherein, the load hook (4) is directly suspended from the slewing means and there is present a coupling frame (15) which is secured against the bottom of the slewing means (14), while on the top side of said slewing means, in the angular points of the slewing means (13), there are accommodated four rope or traction sheaves (16) which are interconnected pairwise by means of connecting shafts (17), each hoisting rope (2) being guided over one of said front pulleys (1), a rope or traction sheave (16) disposed on the slewing means (6) back to a rope attachment point (18) in the top of the crane jib.

7. A crane according to claim 6, wherein the front pulleys (1) and the rope attachment points (18) are positioned in the angular points of a rectangle, while the front pulley (1) associated with each hoisting rope (2)

and the rope attachment point (18) for said rope (2) are positioned diagonally opposite each other, while the associated rope or traction sheave (16) is positioned on the diagonal of the slewing means (6) which intersects said first mentioned diagonal.

8. A crane according to claim 7, wherein the connecting shafts (17), dependent on the location of the front pulleys (1) and the rope attachment points (18), interconnect to rope or traction sheaves (16) in such a way that during the hoisting and lowering of the load, two connected rope or traction sheaves (16) have the same direction of rotation, while upon an angular displacement of the slewing means (13), said sheaves (16) exert a torsion moment on the connecting shaft (17), while said connecting shafts (17) are provided with means such as universal joints (19) which enable an inclined position of sheaves (16) relative to the associated shafts (17).

9. A crane according to claim 8 wherein the distance between the slewing table (6) and master trestle (10) is at least four times the maximal container height (H).

10. A crane according to claim 9 wherein the master trestle (10) has the shape of a rectangle which trestle is mounted on the four angular points of the container spreader.

11. A crane according to claim 10 wherein a first rope frame (5) is detachably secured to the hoisting trestle (3).

12. A crane according to claim 11 wherein a second rope frame (9) is detachably secured to the slewing means (6).

* * * * *

UNITED STATES PATENT AND TRADEMARK OFFICE

CERTIFICATE OF CORRECTION

PATENT NO. : 4,168,857
DATED : September 25, 1979
INVENTOR(S) : Petrus Johannes Kloos It is certified that error appears in the above-identified patent and that said Letters Patent are hereby corrected as shown below:

Column 6, claim 1, line 1, "buffing" should be --luffing--.

Column 6, claim 4, line 39, "thereis" should be --there is--.

Column 8, claim 10, line 9, after "spreader" insert --(11)--.

Signed and Sealed this Tenth Day of June 1980

[SEAL]

Attest:

SIDNEY A. DIAMOND

Attesting Officer

Commissioner of Patents and Trademark